United States Patent [19]

Kavanaugh

[11] 4,288,962

[45] Sep. 15, 1981

[54] METHOD OF FORMING STRUCTURAL WALLS AND ROOFS

[76] Inventor: Harvey H. Kavanaugh, 17 W. Cervantes St., Pensacola Beach, Fla. 32501

[21] Appl. No.: 15,732

[22] Filed: Feb. 27, 1979

[51] Int. Cl.[3] ..... B32B 3/26; E04C 2/26; E04B 1/76

[52] U.S. Cl. ..... 52/743; 52/220; 52/309.5; 52/309.11; 52/309.12; 52/746; 52/573

[58] Field of Search ..... 52/743, 746, 309.5, 52/309.12, 309.11, 483

[56] References Cited

U.S. PATENT DOCUMENTS

| | | | |
|---|---|---|---|
| 2,793,403 | 5/1957 | Livingston | 52/483 |
| 3,122,860 | 3/1964 | Schulze | 52/309.11 |
| 3,315,424 | 4/1967 | Smith | 52/309.3 |
| 3,462,892 | 8/1969 | Meyer | 52/221 |
| 3,991,252 | 11/1976 | Kolakowski | 52/309.9 |

*Primary Examiner*—John E. Murtagh
*Attorney, Agent, or Firm*—Harvey B. Jacobson

[57] ABSTRACT

The present invention contemplates a simple and inexpensive, but effective method for constructing straight walls at a building site without use of nails or other fastening means. Appropriately flanged metal I-beam studs are erected with the flanges in the direction of the wall, and expanded polyurethane foam is applied, such as by spraying, to a desired thickness between the I-beam flanges, thereby acting as a fastener and providing insulating properties. A fiberglass-cementitious mixture is then applied to provide a very hard, smooth, waterproof and durable surface of very high fire rating. The invention is equally applicable to interior walls, exterior walls, and roof panels.

1 Claim, 10 Drawing Figures

METHOD OF FORMING STRUCTURAL WALLS AND ROOFS

BACKGROUND OF THE INVENTION

1. Field of the Invention

The invention relates to building construction materials, a method for making construction elements of a building, and an expansion joint to allow for thermal expansion or contraction of a building constructed from such construction elements. More particularly, the invention provides an underlying expanded polyurethane foam supported from appropriately flanged metal I-beam studs, the underlying foam supporting a hard, smooth, durable layer of sprayed-on mixture of fiberglass and cementitious composition which sets to form a fire-resistant, waterproof and durable external surface, firmly secured to the foam with the aid of an appropriate bonding agent. The panels are useful as structural walls or in forming a roof.

2. Description of the Prior Art

Preformed wall panels for use in building construction are known in the prior art. For example, Lemelson in U.S. Pat. No. 3,298,883, issued Jan. 17, 1967, discloses a wall, ceiling, or a partition made from a curved wall panel comprising a flexible array of self-supporting strips shaped to deform and jointed together to form a honeycomb structure. A cellular plastic polymeric material, such as expanded polyurethane, can comprise the frame supporting cellular sheet or slab on which a mortar or filler material can be sprayed to form a hard shell when it hardens. However, the simplicity, conformity with traditional standards of construction, and cost effectiveness of a straight wall or roof panel made from appropriately flanged metal I-beam studs are not present in the Lemelson patent teachings.

Also known in the prior art is a method of constructing a roof having a thermal insulating layer in pre-cut blocks, blanks or sheets, preferably a closed cellular material. The exterior surface is formed of material such as concrete block covered with a roof wearing surfacing composition. Such a roof construction requires rather cumbersome assembly procedures, including extensive cutting, shaping, and fitting operations to conform the individual component parts with the overall roof size requirements. Moreover, such a roof construction appears to have utility only for roofs of flat configuration, which are capable of withstanding foot traffic, rather than roof constructions of the conventional peaked or sloping configuration. Other patents showing an insulated roof construction include U.S. Pat. No. 3,094,447, issued June 18, 1963 to Chamberlain, and U.S. Pat. No. 3,698,972, issued Oct. 17, 1972 to Lenzner.

The prior art further discloses use of insulating joints for joining heat insulating elements and for providing a strong rigid structure therebetween, such as in U.S. Pat. No. 3,251,912, patented May 17, 1966 by Fish. A channel filled with foamed insulating material is bonded to adjacent insulating elements by an adhesive to form a firm joint. Such a joint, however, does not appear to allow for thermal expansion or contraction of the external surface.

U.S. Pat. No. Re. 28,976, reissued Sept. 28, 1978 to Zinn, discloses a method for forming and assembling a sound attenuating wall between fixed structure channels.

It is also known to prepare a cementitious composition of matter for spray forming a concrete layer which hardens to a firm shell, used as a substitute for plaster, gunite, or the like, in building construction. Such a material is manufactured by Owens-Corning and marketed under the trade name "BlocBond", which material is a mixture of Portland cement, hydrated lime, calcium chloride, calcium stearate, and alkali-resistant fiberglass filaments having a length of about one-half inch. Such a composition, however, does not ordinarily effectively bond to polyurethane foam, such as can be applied by spraying and curing to form a stable, insulating, construction material substrate, as those skilled in the art are aware.

SUMMARY OF THE INVENTION

Conventional and traditional shapes of structural walls and roofs are formed using the method of the present invention without the use of nails or other fasteners from appropriately flanged metal I-beam studs erected in the general plane where it is desired to locate the wall or roof. The space between the planes defined by the I-beam flanges is filled with expanded polyurethane applied by spraying or the like as a foam, which then cures to a solid, durable substance in a conventionally known manner. The expanded polyurethane foam acts as a substrate for supporting a fiber glass-cementitious mixture, which is sprayed on the exterior surface and allowed to set. The expanded polyurethane foam also provides a high degree of thermal insulation with respect to transfer of heat through the wall or roof, and acts as a barrier to transmission of sound and vibration. The exterior cementitious layer has a hard smooth finish, and is fire resistant, a combination of properties which impart utility as a safe, effective building construction material.

Accordingly, it is an object of the invention to provide a method for forming a structural wall or roof on a plurality of support studs, upon which expanded polyurethane foam is deposited, as by spraying, to act as a fastener and insulating agent.

Another object of the invention is to provide a method for forming such building components wherein an exterior layer of a fiber glass-cementitious mixture is applied to the expanded foam, forming a smooth, durable, waterproof, and fire resistant external surface.

Still another object of the invention is to provide an expansion joint for use in connection with the wall structure or roof structure to allow for heat expansion or contraction of the external surface thereof.

Yet another object is to provide a very simple, inexpensive, and versatile method for constructing walls and roofs of traditional straight, generally planar configuration without necessitating the labor costs of skilled laborers for applying nails or other similar fasteners.

A further object is to provide an appropriately flanged metal I-beam stud on which the expanded polyurethane foam is supported.

Another further object is to provide a method for forming structural walls and roofs which avoids the necessity for cutting, shaping, or otherwise adapting a preformed construction panel to the geometry required in actual construction, taking into account obstructions such as windows, irregular edges, doors, and the like.

Still another further object is to simplify the process of planning for building construction, inasmuch as dimensions which are not an exact multiple of a standard building panel length are just as easy to design into a building plan for a building using the method of the present invention as are dimensions which do constitute such an even multiple.

Yet another further object is to disclose a process for creating a positive bond between the urethane foam and the cementitious exterior layer, thereby allowing the foam to act as a cushion for the cement-fiber glass layer by absorbing and dampening vibrations, sound or direct blows.

Another important object is to provide an exterior coating in the form of cementitious material which avoids forming potentially combustible fumes, thereby totally eliminating any hazard of explosion or combustion of fumes generated during construction of the building.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
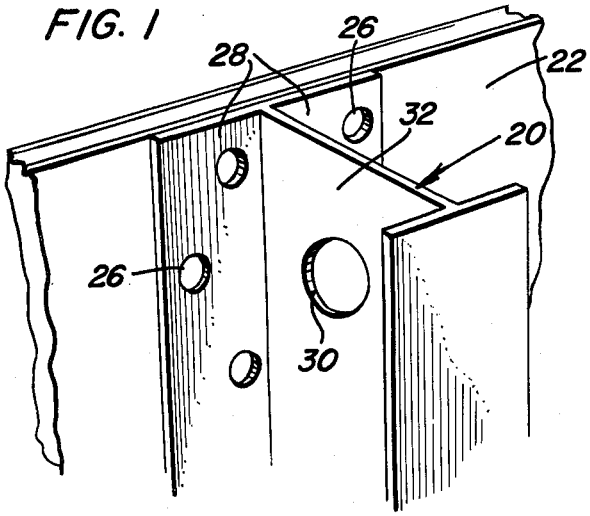
FIG. 1 is a perspective view of a mounting stud of the present invention, showing the stud in the form of an I-shaped beam perforated with hole placed at alternating intervals along the length of the I-beam.

The steps in the process used in forming structural walls by the method of the present invention is best illustrated in FIGS. 1–4. In FIG. 1, metal stud 20 is shown erected in place with interior plasterboard 22, such as that sold under the trademark Sheetrock, having been placed against the interior wall side of metal stud 20. Preferably, metal stud 20 is a light weight aluminum I-beam erected or "tacked" into place along the building foundation, and separated from adjacent studs by a standard interval, such as about sixteen inches. This arrangement resembles the conventional 2-inch by 4-inch lumber studs forming a traditional building wall framework. Interior plasterboard 22 is held against metal stud 20 either manually or by other suitable fastening means. High-density urethane foam 24 is then sprayed to a desired thickness on the exterior side of plasterboard 22, bonding to plasterboard 22 and bonding the plasterboard in place. Perforations 26 in flanges 28 of metal stud 20 assist in forming a positive bond between foam 24 and plasterboard 22. Perforations 26 on flanges 28 are preferably staggered, as shown in FIG. 1, down the length of the I-beam so as not to diminish the structural strength of the beam. In addition, larger web perforations 30 are provided in web 32 of stud 20 in order to allow the foam to bond through the I-beam as well as around the beam. Perforations 26 and 30 moreover reduce the overall weight and cost of the construction materials and serve to reduce the overall building weight, without appreciably weakening the structure. Perforations 30 can serve the further useful purpose of allowing passage of electrical conduit and plumbing. Preferably, web perforation 30 is somewhat larger than perforations 26 in order to accommodate the additional purpose served.

Figure 2:
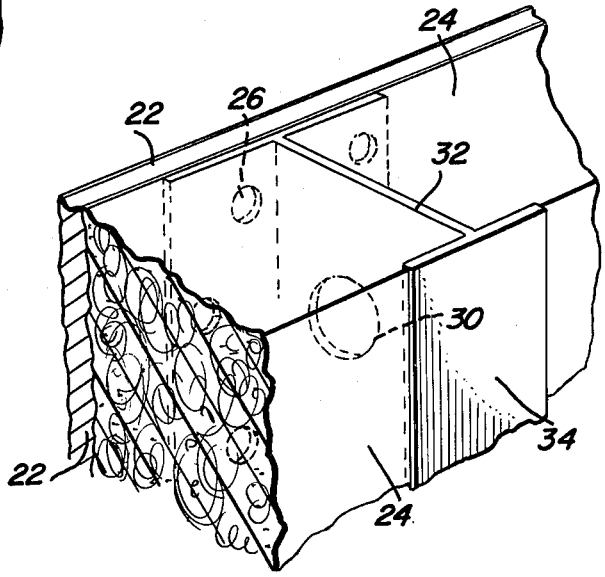
FIG. 2 is a perspective view of the same arrangement after the next step in the process, namely the application of expanded foam.
Figure 3:
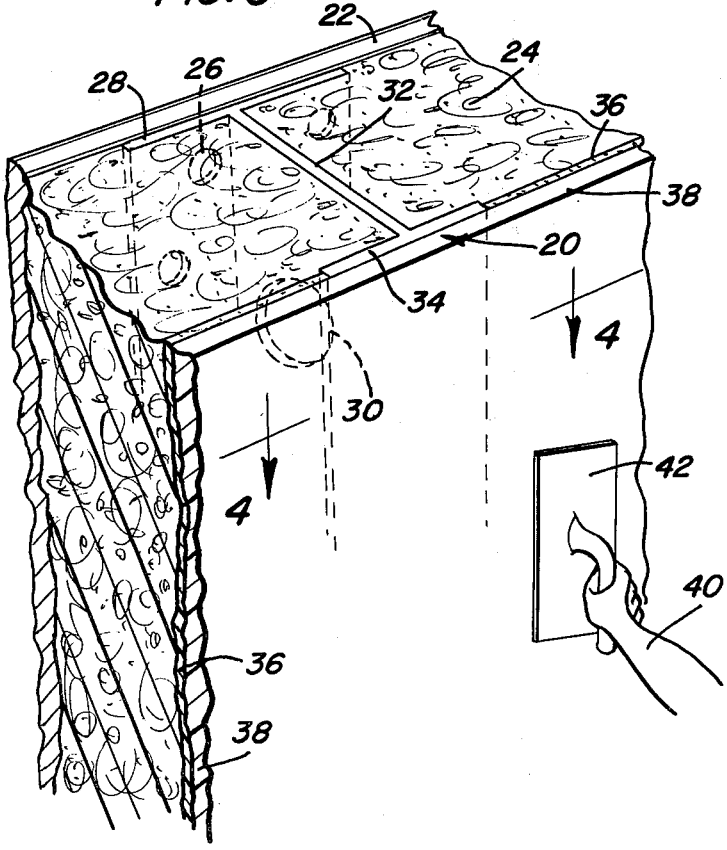
FIG. 3 is a perspective view of the same arrangement after the next step in the process, namely application of the exterior layer of cementitious material, showing hand troweling to a smooth finish.
Figure 4:
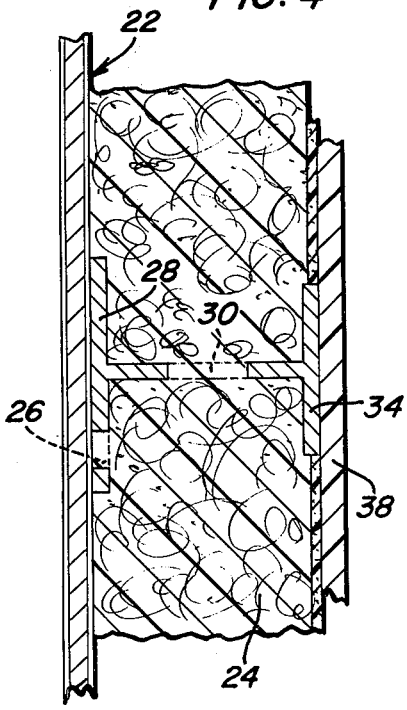
FIG. 4 is a sectional view of the wall section of FIG. 3 after curing of the cementitious layer, taken substantially upon a plane passing along section line 4—4 on FIG. 3.
Figure 5:
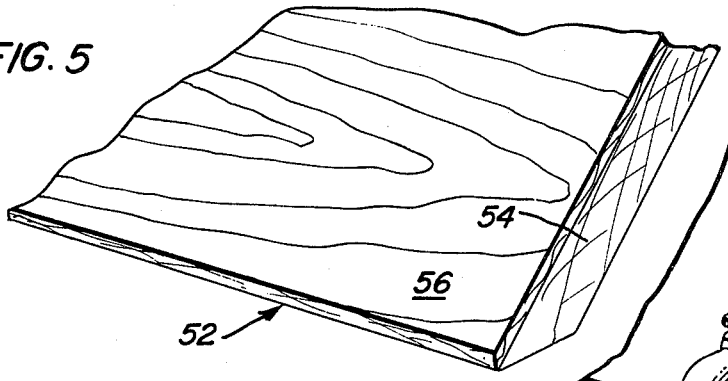
FIG. 5 is a fragmentary view of a section of roof sheeting prior to the first step in forming a structural roof by the method of the present invention.

As is apparent from FIG. 2, expanded foam is applied outwardly from plasterboard 22 to the level of flange 34. Bonding can occur through web performation 30 to help form a positive bond by joining the foam mass on each side of web 32 or, perforation 30 can receive therethrough an electrical line, plumbing, or the like. Adhesive 36 is a special bonding agent sprayed on the exterior side of foam 24, and enabling a cementitious fiber glass mixture 38 to adhere to foam 24. FIG. 3 shows cementitious layer 38 in the process of application wherein the external surface is hand troweled by operator 40 with use of trowel 42. Preferably, cementitious layer 38 is sprayed over foam 24 to the desired thickness, giving a smooth, hard, durable exterior wall when hand troweled and allowed to harden. Plasterboard 22 is then finished in a conventional manner to form a traditional interior wall. Cementitious layer 38 is preferably a composition made up of Portland cement, hydrated lime, calcium chloride, calcium stearate, and alkali-resistant fiber glass filaments having a length of about one-half inch. Such a mixture is commercially available from Owens-Corning Fiberglas Corporation, and is sold under the trademark of "BlocBond". Bonding agent 36 is preferably a concrete bonding adhesive, such as disclosed in U.S. Pat. No. 2,760,885 issued Aug. 28, 1956 or one sold under the trade name "Bonsal Concrete Bonding Adhesive", available from W. R. Bonsal Company, Lilesville, N.C. It is important that cementitious layer 38 be applied in a thickness of at least one-half inch, since the effectiveness of bonding is considerably reduced with a thickness less than one-half inch. Advantages of the present method include efficiency in allowing insulated walls to be erected quickly, without requiring use of fastening means, such as nails, or the like. Such efficiency can result in substantial labor cost savings, and can reduce the time required for building construction, thereby making it possible for building contractors to commit to an earlier deadline where urgency of construction is a factor. Moreover, with use of aluminum studs 20, overall weight savings are effected, having the advantage of permitting architectural flexibility in design, such as permitting a greater height of multiple story building construction where an overall limit exists on the building weight supportable at the foundation.

Figure 10:
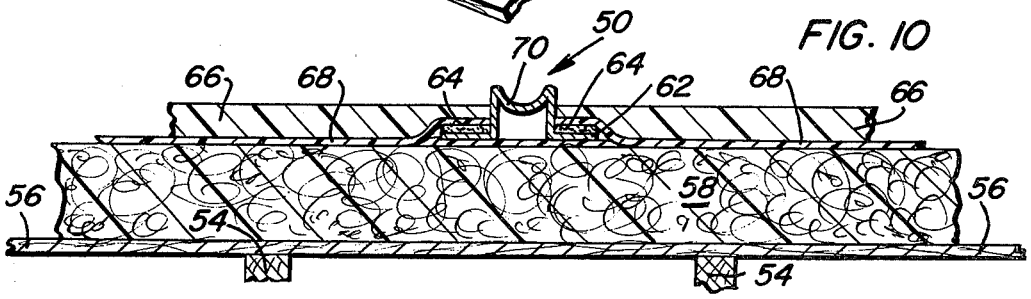
FIG. 10 is a sectional view of the final cured roof product prepared by the method of the present invention, taken substantially upon a plane passing along section line 10—10 on FIG. 9.

FIGS. 5–10 disclose a method of forming roofs utilizing the same expanded cellular foam and the same cementitious composition as disclosed in the method for forming structural walls, with the exception that metal studs 20 are not required, and instead expansion joints, such as that designated by the numeral 50 in FIG. 10, are a part of the structural roof. Roof base 52 is formed from any conventional materials, such as standard trusses 54 and plywood sheets 56.

Figure 6:
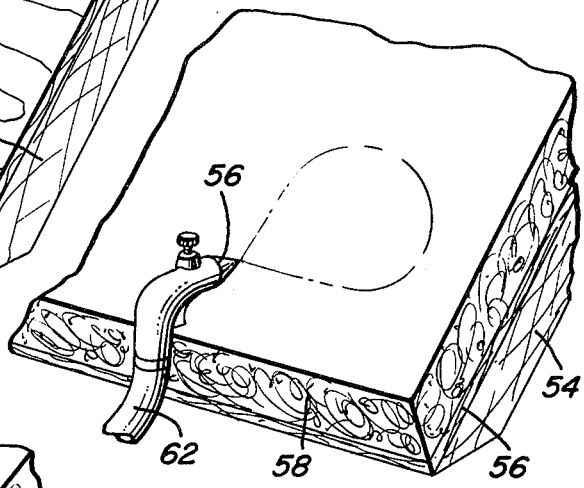
FIG. 6 is a perspective view of the same portion of roof showing application of supporting expanded foam by a sprayer device.

In FIG. 6, foam layer 59 is undergoing application by spraying through nozzle 60, which is connected by hose 62 to a supply of appropriate composition for generating expanded cellular polyurethane or other foam in a conventional manner.

Figure 7:
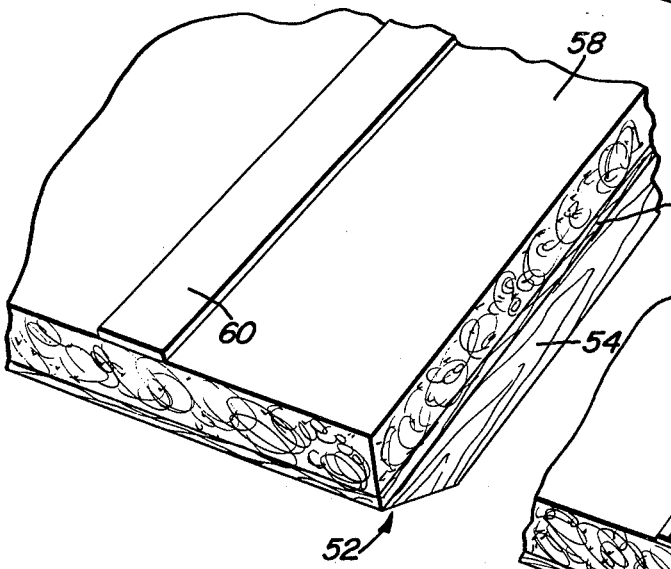
FIG. 7 is a perspective view of the foamed roof, additionally showing a strip of roofing material painted directly over the cured urethane foam.
Figure 8:
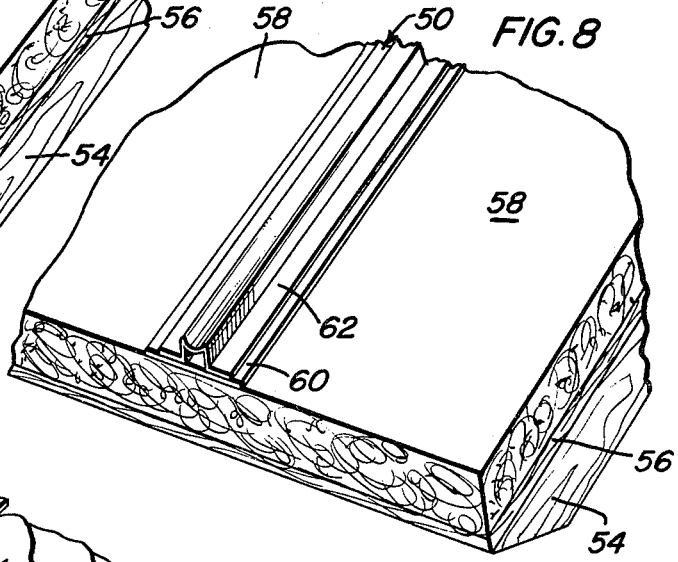
FIG. 8 is a perspective view showing additionally an expansion joint placed over the strip of roofing material.
Figure 9:
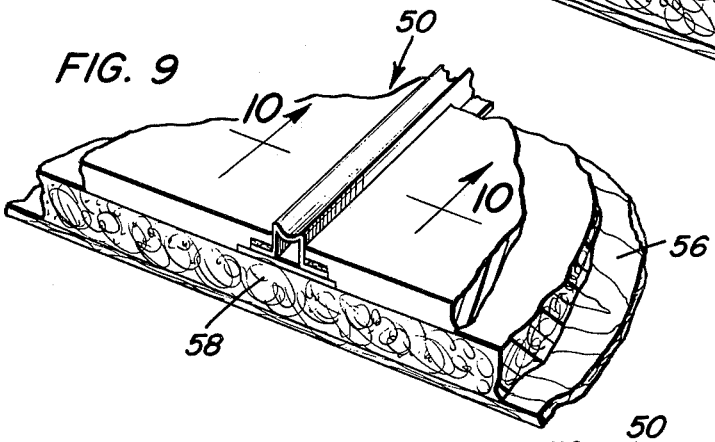
FIG. 9 is a perspective view after the cementitious layer has been applied to the expanded foam support.

FIG. 7 shows foam layer 58 after curing or hardening on roof base 52. A strip of roofing material 60 has been applied on the upper or exterior surface of foam layer 58, having a width greater than that of expansion joint 50 to be subsequently applied upon strip 60. Roofing material strip 60 is preferably a commercial product sold under the trade name "Roof-Flex", which is painted directly over the cured foam layer on the location at which the expansion joint is to be placed. Expansion joint 50, which is preferably constructed of a synthetic resin plastic material, is placed upon roofing material strip 60 in the manner shown in FIG. 8. Expansion joint 50 can be conveniently pre-fabricated in lengths of about 10 feet, for use in the present invention. The expansion joint 50 is then centered on strip 60 and an additional coating of roofing material, such as "Roof-Flex" is applied to cover lips 62 of expansion joint 50. This additional layer of roofing material, serving the purpose of temporarily securing expansion joint 50 to foam layer 58, serves the additional purpose of promoting adhesion of subsequently applied cementitious layer 66 to expansion joint 50. This additional purpose is promoted by embedding sand in the layer of roofing material placed on the lips 62 of expansion joint 50, such sand containing layer being designated by the numeral 64 in FIG. 10. A layer 68 of special bonding agent, such as that commercially available from W. R. Bonsal Company, as described above, is then applied, such as by spraying. Cementitious layer 66 is then applied, preferably comprising the material described above as "Bloc-Bond", a mixture of Portland cement, hydrated lime, calcium chloride, calcium stearate, and alkali-resistant fiber glass filaments cut to lengths of about one-half inch. Cementitious layer 66 is then hand-troweled to a smooth, hard, durable exterior surface and allowed to set in the well known manner.

The method of the invention allows insulated, permanent roofs to be formed quickly and in virtually any shape or configuration, but is particularly advantageous with roofs of traditional peaked construction. Moreover, it is not necessary to first cast the exterior cementitious layer for subsequent fastening or bonding to an underlying foam layer, inasmuch as the present method discloses bonding of the cementitious layer directly to the insulating foam layer in a manner which permits forming a hard, smooth, durable surface and furthermore provides the overall construction with a very high fire rating. Moreover, use of high-density urethane foam as an underlying intermediate layer and insulating material provides a very high degree of resistance to thermal energy transfer. Stated otherwise, a very high insulation factor or "R" value results from use of the method of the present invention.

A further advantage of use of the method of the present invention is elimination of steel reinforcing required in many prior art structural wall or roof construction methods, particularly where cementitious materials are utilized. In methods using steel reinforcing, any exposed steel can be expected to undergo corrosion over a period of time, particularly in roof construction, thereby seriously weakening the structure and leading to the possibility of further consequential damage, such as leakage, rotting, and the like. Moreover, elimination of all wire steel reinforcing promotes the advantage of reducing the time consumed in erecting structural walls and roofs, and further reduces the cost of materials required.

Another advantage of the method and construction of the present invention resides in the dampening effect on the polyurethane substrate layer with respect to vibrations, including mechanical vibrations and sound, as well as direct blows. Since the cementitious layer forms a concrete shell separate and apart from the outer polyurethane foam, this unified aspect causes the polyurethane foam to act as a cushion for the cementitious layer, thereby absorbing and dampening intrusive vibrations and promoting overall suitability of the structural walls and roofs in building construction.

A further important advantage of the present invention resides in the properties of cementitious materials undergoing setting. Although the structural walls and roofs of the present invention are suited generally for applications in which the cementitious layer is exposed to the outside, other applications exist in which the cementitious layer will be within an enclosed region, where evaporating vapors can be expected to accumulate in an enclosed region. Inasmuch as the cementitious layer of the present invention does not evolve combustible fumes, unlike certain prior art compositions, such as fiber glass resin materials, work in the construction environment can proceed without special precautions against hazards of explosion or asphyxiation due to evolution of fumes from the outer layer. Another advantage over the prior art materials, such as fiber glass coatings, results from the nature of the bonding in the method of the present invention. When prior art coatings, such as fiber glass resin materials, are used over a supporting matrix, seepage of water through the outer layer can cause the outer layer to release from the the underlying urethane and peel away in sheets. With the method of the present invention, this phenomenon does not occur, even if the cementitious layer is cracked or punctured, due to the nature of bonding between the cementitious layer and foam layer. Accordingly, the overall lifetime of the structural walls and roofs is lengthened, a consideration of considerable importance for long term construction, where replacement of roofs or the like is an expensive undertaking and damage to walls constitutes a safety hazard, as well as a potential expense in repair.

It will be noted from FIG. 10 that expansion joint 50 permits by its construction lateral motion of blocks of cementitious layer 66 with respect to each other through flexing of concave trough 70. This movement is particularly important in roof constructions for a surface facing in a southerly direction, where temperature differentials between night and day can be extreme due to daytime absorption of heat from incident direct sunlight and nighttime radiative cooling. Accordingly, during the daytime, lips 62 of expansion joint 50 will move toward each other, with deepening of trough 70, as blocks of cementitious layer 66 expand and the edges move toward each other at expansion joint 50. Similarly, as cementitious layers 66 cool due to seasonal, diurnal, precipitation, and other factors, lips 62 will move away from each other, and trough 70 will become more shallow. In this manner, cracking of cementitious layer 66 is minimized or substantially reduced, thereby prolonging the life of the structural roof and extending the time when replacement of the roof would be required. Moreover, flexing of expansion joint 50 occurs in a manner which maintains the sealing relationship between all parts exposed to the outside, and leakage or entry of moisture from the outside is thereby at all times substantially avoided.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. The method of forming a structural wall in place comprising the following steps:

(a) erecting vertically in spaced relation a plurality of support studs;

(b) placing a section of plasterboard on the side of the support studs facing the interior side of the structural wall;

(c) spraying a layer of high density expanded cellular foam to the plasterboard from the side exterior to the structural wall to substantially fill the space between the studs;

(d) allowing the foam layer to cure to form a solid insulating layer;

(e) spraying a layer of bonding agent over the exterior exposed surface of said insulating layer so that the inner surface of the bonding agent and stud are coplanar;

(f) spraying a layer of cementitious material to said bonding agent and inner surface of the stud in a continuous thickness of at least one-half inch without including reinforcements; and (g) allowing said cementitious layer to cure to form a smooth, hard, durable exterior wall layer, said support stud being a metal I-beam having substantially parallel flanges in the plane of said structural wall, the flanges being joined by a web, the I-shaped beam being of unitary construction, said cementitious material being a mixture of Portland cement, hydrated lime, calcium chloride, calcium stearate, and alkali-resistant fiber glass filaments approximately one-half inch in length, and said expanded cellular foam is a polyurethane synthetic resin, said metal stud being aluminum and the outer flange having a width less than the width of the interior flange, the interior flange being perforated to facilitate bonding of the plasterboard with the foam layer, said inner perforated flange having a plurality of perforations in staggered configuration along the I-shaped beam, and the web of said beam is perforated to allow passage therethrough of electrical conduit, plumbing and the like.

* * * * *